US007398579B2

(12) United States Patent
Moshenrose

(10) Patent No.: US 7,398,579 B2
(45) Date of Patent: Jul. 15, 2008

(54) ERGONOMIC APPLIANCE HANDLE

(75) Inventor: Paul A. Moshenrose, Ocean Springs, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 158 days.

(21) Appl. No.: 10/994,017

(22) Filed: Nov. 19, 2004

(65) Prior Publication Data

US 2006/0112521 A1 Jun. 1, 2006

(51) Int. Cl.
*A45C 3/00* (2006.01)

(52) U.S. Cl. ..... 16/430; 16/445; 15/410

(58) Field of Classification Search ..... 16/430, 16/436, 438, 445, 408; 15/410, 143.1, 144.1, 15/145

See application file for complete search history.

(56) References Cited

U.S. PATENT DOCUMENTS 3,751,094 A * 8/1973 Bohler ..... 294/58
4,452,097 A * 6/1984 Sunkel ..... 74/502.4
4,594,801 A * 6/1986 Gronwick et al. ..... 38/90
5,083,340 A * 1/1992 Takahashi et al. ..... 15/410
5,207,755 A * 5/1993 Ampian ..... 15/230.11
5,331,720 A * 7/1994 Beckingham ..... 16/426
5,996,175 A * 12/1999 Fusco ..... 15/410
6,101,672 A 8/2000 Conrad et al.
6,101,678 A * 8/2000 Malloy et al. ..... 16/438
6,401,301 B1 * 6/2002 Hung ..... 16/430
7,194,784 B2 * 3/2007 Overvaag et al. ..... 15/410
2002/0042969 A1 * 4/2002 Nagai et al. ..... 15/410
2003/0009854 A1 * 1/2003 Shippert ..... 16/430
2004/0261211 A1 * 12/2004 Overvaag et al. ..... 15/327.1
2005/0125944 A1 * 6/2005 Ji ..... 15/410
2005/0210626 A1 * 9/2005 Joung et al. ..... 15/410

FOREIGN PATENT DOCUMENTS

JP 01285301 A * 11/1989
JP 06062985 A * 3/1994
JP 06062992 A * 3/1994

* cited by examiner

*Primary Examiner*—William L. Miller
(74) *Attorney, Agent, or Firm*—The Ollila Law Group LLC

(57) ABSTRACT

An ergonomic appliance handle is provided according to an embodiment of the invention. The appliance handle includes a base adapted to be affixed to a handle portion of an appliance, a handle grip, and a pivot device for pivotally attaching the handle grip to the base. The pivot device is positioned at a first location on the base. The pivot device allows the handle grip to pivot on the base between at least two pivoting positions. The appliance handle further includes a pivot restraint device for removably latching the handle grip in a closed position of the at least two pivoting positions. The pivot restraint device is positioned at a second location on the base that is spaced-apart from the first location.

27 Claims, 5 Drawing Sheets

ERGONOMIC APPLIANCE HANDLE

TECHNICAL FIELD

The present invention relates to an appliance handle, and more particularly, to an ergonomic appliance handle.

BACKGROUND OF THE INVENTION

Vacuum cleaners are widely used to pick up dirt and debris. A typical upright vacuum cleaner includes a handle that is used to push and pull the vacuum cleaner. A typical prior art vacuum cleaner handle comprises an elongate member that includes an elongate, cylindrical hand grip.

A prior art vacuum cleaner handle offers a very limited or no adjustment capability. This is ergonomically unsatisfactory, especially considering the size and weight of a typical vacuum cleaner. Commonly, a prior art vacuum cleaner handle can pivot at its base, wherein the whole handle apparatus can be elevated or depressed. The relative angle and position of the prior art handle grip is not adjustable.

It is known that in proper ergonomic design of a handle that the hand grip and a hand position can be greatly adjusted in order to accommodate a user. For example, in a good ergonomic design, a handle should accommodate left and right-handedness, the user's overall height and hand height, wrist angle, the task to be performed, the height of the work surface, the type and texture of the work surface, etc.

SUMMARY OF THE INVENTION

An ergonomic appliance handle is provided according to an embodiment of the invention. The ergonomic appliance handle comprises a base adapted to be affixed to a handle portion of an appliance, a handle grip, and a pivot means for pivotally attaching the handle grip to the base. The pivot means is positioned at a first location on the base. The pivot means allows the handle grip to pivot on the base between at least two pivoting positions. The ergonomic appliance handle further comprises a pivot restraint means for removably latching the handle grip in a closed position of the at least two pivoting positions. The pivot restraint means is positioned at a second location on the base that is spaced-apart from the first location.

An ergonomic appliance handle is provided according to an embodiment of the invention. The ergonomic appliance handle comprises a base adapted to be affixed to a handle portion of an appliance, a handle grip, and a pivot means for pivotally attaching the handle grip to the base. The pivot means is positioned at a first location on the base. The pivot means allows the handle grip to pivot on the base between at least two pivoting positions. The ergonomic appliance handle further comprises a pivot restraint means for removably latching the handle grip in the at least two pivoting positions. The pivot restraint means is positioned at a second location on the base that is spaced-apart from the first location. The ergonomic appliance handle further comprises a detent means for restraining a pivotal motion of the handle grip at one or more predetermined detent locations.

An ergonomic appliance handle is provided according to an embodiment of the invention. The ergonomic appliance handle comprises a base adapted to be affixed to a handle portion of an appliance, a handle grip, and a pivot means for pivotally attaching the handle grip to the base. The pivot means is positioned at a first location on the base. The pivot means allows the handle grip to pivot on the base between at least two pivoting positions. The ergonomic appliance handle further comprises a pivot restraint means for removably latching the handle grip in a closed position of the at least two pivoting positions. The pivot restraint means is positioned at a second location on the base that is spaced-apart from the first location. The ergonomic appliance handle further comprises a power switch located in the handle grip portion and wiring extending from the power switch and through the pivot means to the base.

An ergonomic appliance handle is provided according to an embodiment of the invention. The ergonomic appliance handle comprises a base adapted to be affixed to a handle portion of an appliance, a handle grip, and a pivot means for pivotally attaching the handle grip to the base. The pivot means is positioned at a first location on the base. The pivot means allows the handle grip to pivot on the base between at least two pivoting positions. The ergonomic appliance handle further comprises a pivot restraint means for removably latching the handle grip in a closed position of the at least two pivoting positions. The pivot restraint means is positioned at a second location on the base that is spaced-apart from the first location. The handle grip pivots between a first position with the pivot restraint means operatively restraining the handle grip to the base and a second position wherein the handle grip is at a maximum pivotal position. The handle grip can pivot substantially continuously between the first position and the second position. The ergonomic appliance handle further comprises a stop means for clamping the handle grip to the base at any pivoting position. The stop means is positioned at the first location and operatively clamps the handle grip to the base at any pivoting position.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-5 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
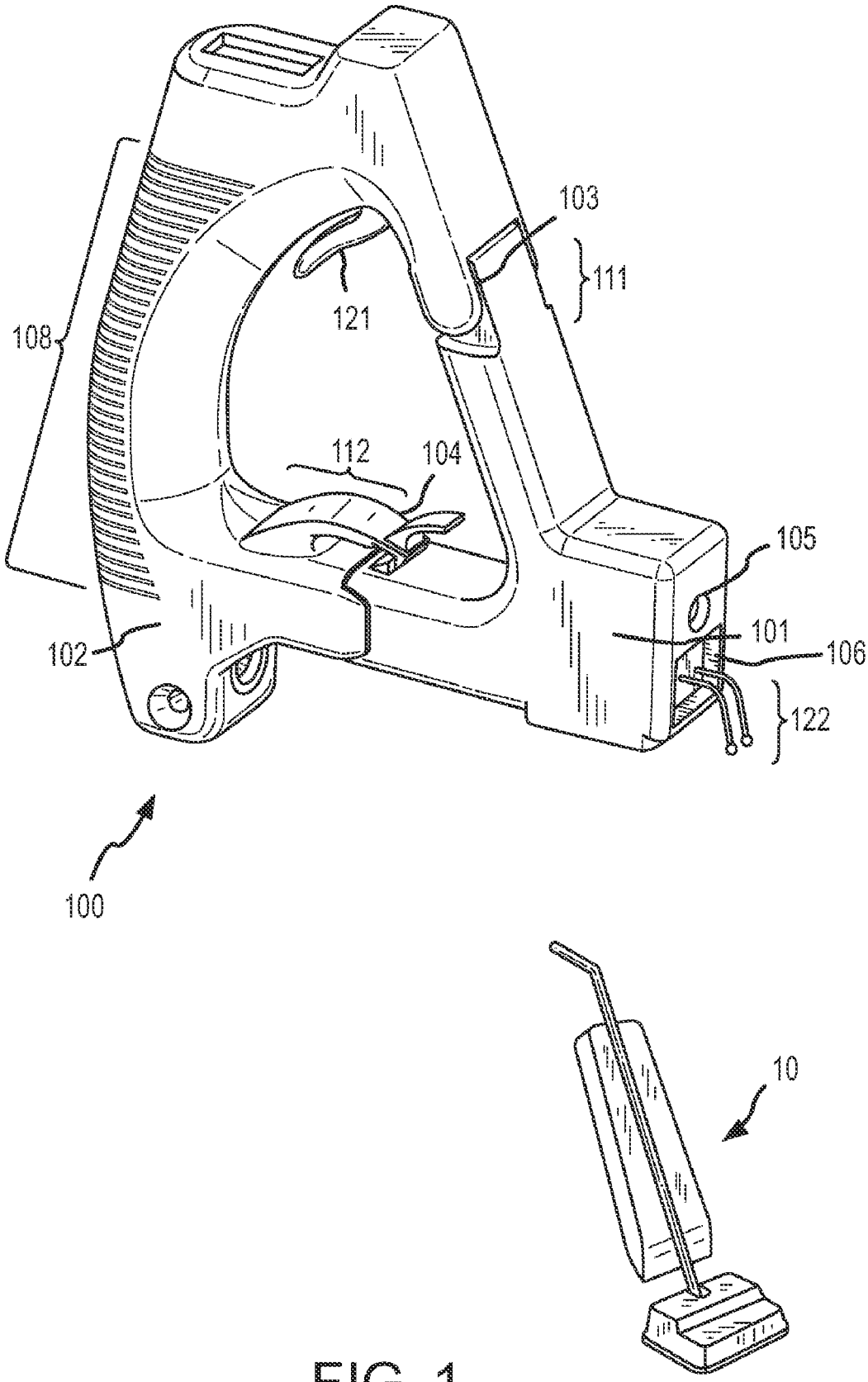
FIG. 1 shows an ergonomic appliance handle according to an embodiment of the invention.

FIG. 1 shows an ergonomic appliance handle 100 according to an embodiment of the invention. The appliance handle 100 includes a base 101 and a handle grip 102 (also see FIG. 2). The handle grip 102 can pivot with respect to the base 101. The handle grip 102 is attached to the base at a first location 111 by a pivot device 103. Further, the handle grip 102 can attach to the base 101 at a second location 112 by a pivot restraint device 104. The second location 112 is spaced-apart from the first location 111. The ergonomic appliance handle 100 according to the invention therefore differs from the prior art by providing a pivoting appliance handle that includes a pivot restraint device 104 that is spaced-apart from the pivot device 103.

The base 101 can be permanently or removably affixed to an appliance handle 10. The base 101 can include a fastener aperture 105, wherein the fastener aperture 105 receives a fastener that affixes the base 101 to the appliance handle. In one embodiment the fastener aperture 105 can comprise a threaded aperture and the fastener can comprise a bolt or screw, but alternatively the fastener can be retained in the fastener aperture 105 by friction, by a snap fit, by a biasing device, etc.

The base 101 can further include a handle aperture 106. An appliance handle in one embodiment fits at least partially into the handle aperture 106. Alternatively, the appliance handle can fit at least partially over the base 101.

The handle grip 102 can include a grip region 108 that can be designed to fit a hand of a user of the appliance. The grip region 108 can include any manner of friction-enhancing features, such as ribbing, grooving, knurling, bumps, ridges, or other projections, grooves or other depressions, etc.

The handle grip 102 in some embodiments can include an electrical switch 121. The electrical switch 1212 in some embodiments can comprise a power switch for powering or otherwise operating the appliance. Accompanying wires 122 for the electrical switch 121 can extend through the pivot device 103, into the base 101, and can pass into the appliance handle.

The pivot device 103 allows the handle grip 102 to pivot with respect to the base 101. The pivot device 103 in one embodiment comprises a base pivot aperture 202 formed in the base 101 (see FIG. 2) and some manner of axle 203. The axle 203 can comprise a separate component or can be formed as part of the handle grip 102. However, it should be understood that the pivot device 103 can be formed of other components or other component arrangements, and other pivot devices are within the scope of the description and claims. For example, the pivot device 103 can include the base pivot aperture 202 and two partial axles 203 extending from the handle grip 102, or can include two depressions or blind base pivot apertures 202 formed on the base 101 and two corresponding bumps or stub axles 203 on the handle grip 102 that engage the depressions or blind base pivot apertures 202. Alternatively, the axle 203 can comprise a fastener that allows pivotal action (see FIG. 2).

The pivot restraint device 104 allows the pivotal motion of the handle grip 102 to be restrained. The pivot restraint device 104 can engage the base 101 in order to restrain the pivotal motion of the handle grip 102. The pivot restraint device 104 can comprise a latch, a spring clip, or a biasing member, for example. It should be understood that other pivot restraint devices are contemplated and are within the scope of the description and claims.

In one embodiment, the pivot restraint device 104 comprises one or more biasing members 205 and one or more corresponding restraint projections 206. In one embodiment, a biasing member 205 can engage a restraint projection 206 formed in the base 101 (see FIG. 2 and the accompanying discussion). However, it should be understood that the pivot restraint device 104 can comprise other configurations and components, such as a movable or pivotable biasing member 205, for example.

Figure 4:
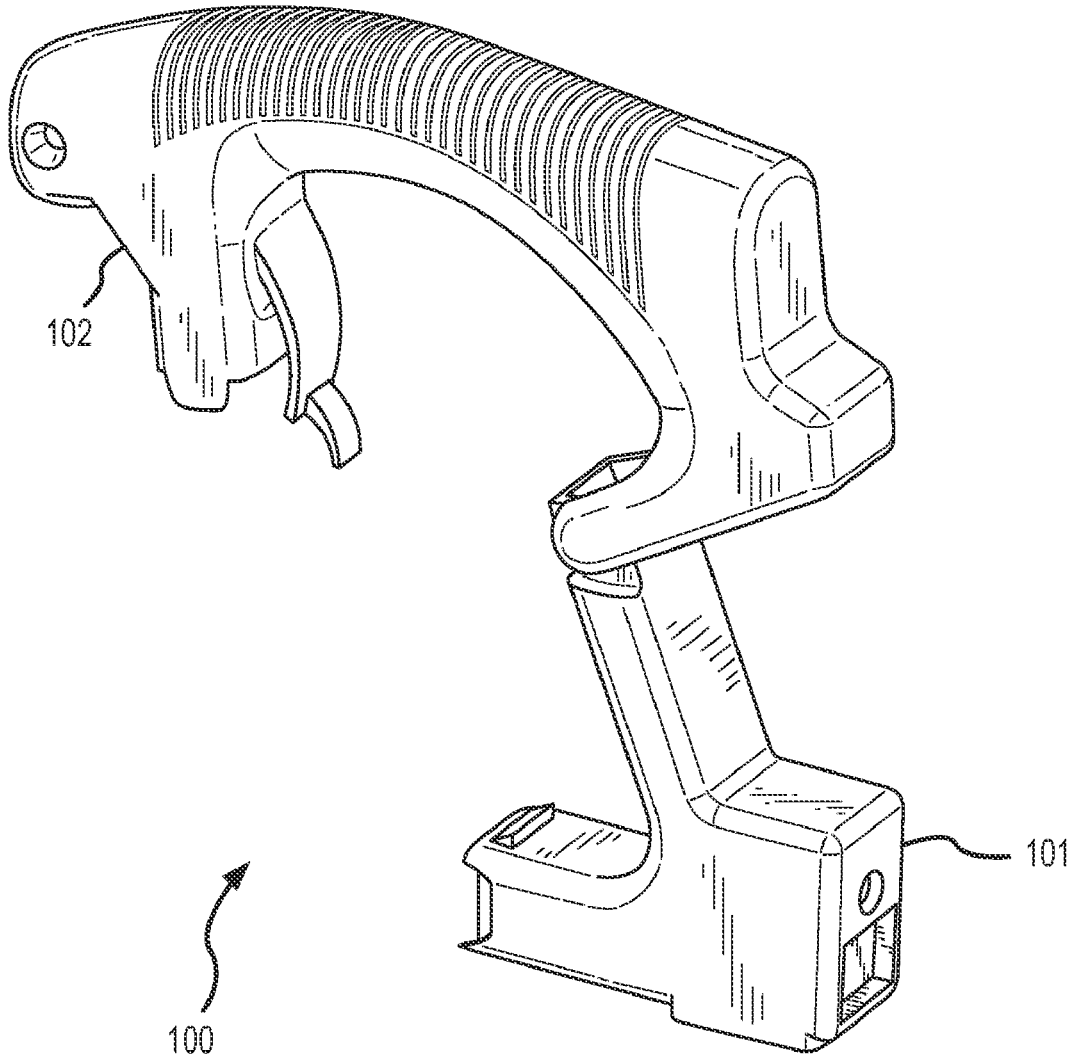
FIG. 4 shows the handle grip in a fully opened or fully pivoted position with respect to the base.

In one embodiment, the handle grip 102 can be pivoted between a first position and a second position, such as the fully open (i.e., fully pivoted) position shown in FIG. 4 and the fully closed (i.e., latched) position shown in FIG. 1.

In another embodiment, the handle grip 102 can be pivoted continuously between the first position and the second position, i.e., the handle grip 102 can be pivoted to any desired pivotal orientation between the two end points. This embodiment allows the pivotal orientation to be fully adjustable (see FIG. 3).

Figure 2:
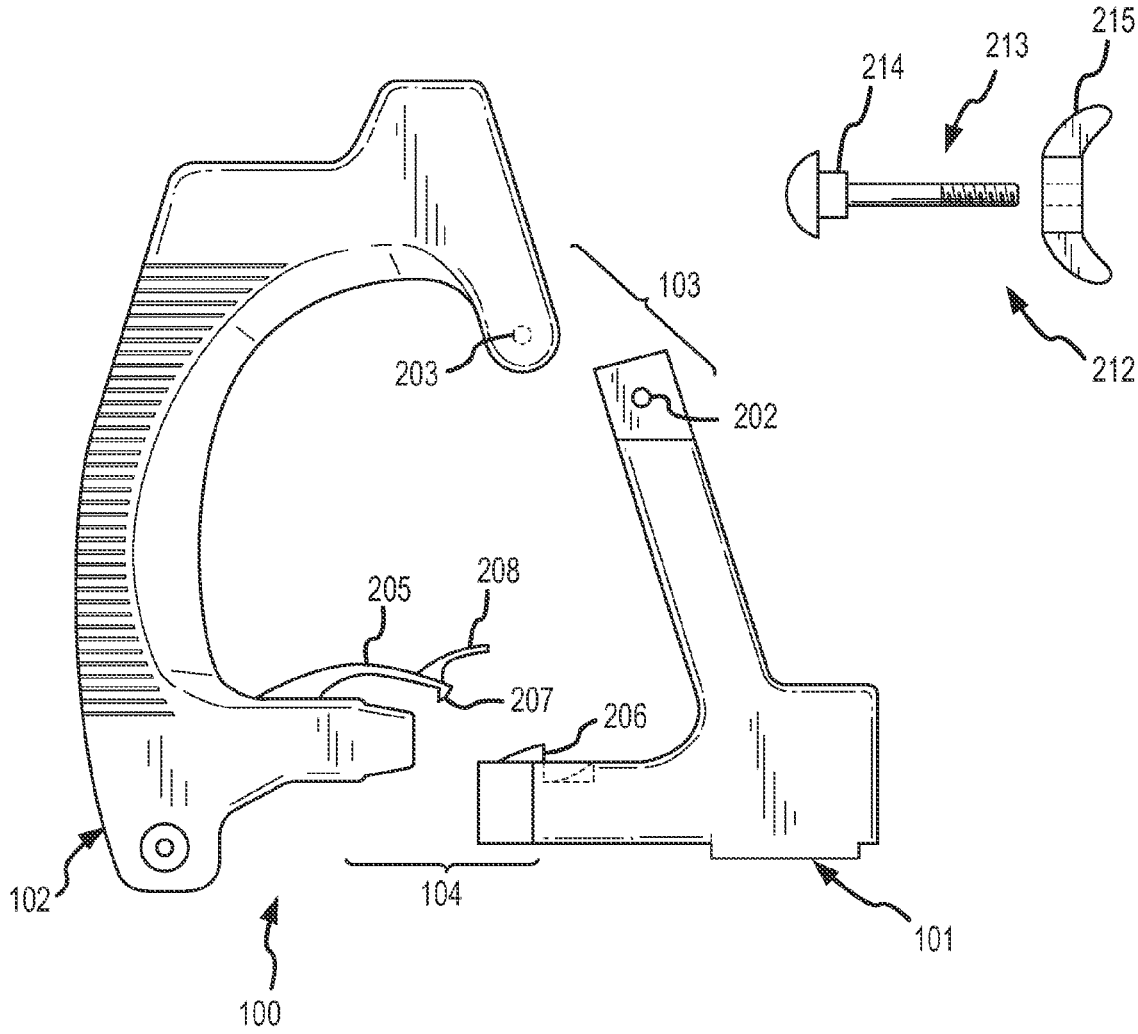
FIG. 2 shows additional detail of the ergonomic appliance handle according to an embodiment of the invention.

FIG. 2 shows additional detail of the ergonomic appliance handle 100 according to an embodiment of the invention. In this figure the base 101 and the handle grip 102 are separated to show detail of the pivot device 103 and the pivot restraint device 104. The pivot device 103 can comprise a base pivot aperture 202 formed in the base 101. A corresponding axle 203 is included in or formed as part of the handle grip 102. The axle 203 is of a size to fit into and rotate in the base pivot aperture 202. The axle 203 therefore pivotally retains the handle grip 102 to the base 101.

It should be understood that in an alternative embodiment the aperture can be formed on the handle grip 102 and the axle 203 can comprise a part of the base 101. In another alternative, both the base 101 and the handle grip 102 can include pivot apertures, and the axle 203 can pass through both the base 101 and the handle grip 102. It should also be noted that the axle 203 can comprise projections or stub axles that extend from the handle grip 102, and the axle 203 does not have to be a separate component assembled to the handle grip 102.

The pivot restraint device 104 in the embodiment shown comprises a biasing member 205 and a restraint projection 206. In a closed position of the handle grip 102 (see FIG. 1), an ear 207 of the biasing member 205 engages the restraint projection 206. It should be understood that alternatively the restraint projection 206 can be replaced with some manner of depression (see dashed line) that receives the ear 207 of the biasing member 205. The biasing member 205 is at least partially flexible in order to deform and engage the restraint projection 206. To release the pivot restraint device 104, a user must pull the biasing member 205 upward enough to flex the biasing member 205 and disengage the ear 207 from the restraint projection 206. To aid in releasing the biasing member 205, the biasing member 205 can include a finger bar 208 that can be grasped by the user in order to manipulate the biasing member 205 and engage and disengage the biasing member 205 and the restraint projection 206.

It should be understood that the placement of the biasing member 205 and the restraint projection 206 can be switched around. It should be further understood that the pivot restraint device 104 can comprise other components or arrangements, and are within the scope of the description and claims.

In yet another alternative embodiment, the pivot device 103 can include a stop device 212, such as a fastener 212 (shown). The fastener 212 can replace the axle 203, and can extend completely through the base 101 and the handle grip 102. The fastener 212 can be manually operated (i.e., tightened) by a user to operatively clamp the handle grip 102 to the base 101 at any pivoting position. The clamping action can be released by un-tightening the fastener 212.

The fastener 212 in one embodiment comprises a threaded fastener, such as a bolt 213 and a corresponding threaded nut 215. In one embodiment, the bolt 213 can comprise a carriage bolt including a square shoulder portion 214 that fits into a corresponding square aperture in the base 101 or the handle grip 102 and prevents rotation of the bolt 213. In one embodiment, the nut 215 comprises a wing nut (shown), but other nut configurations can alternatively be employed. It should be understood that other fastener devices are contemplated and are within the scope of the description and claims.

Figure 3:
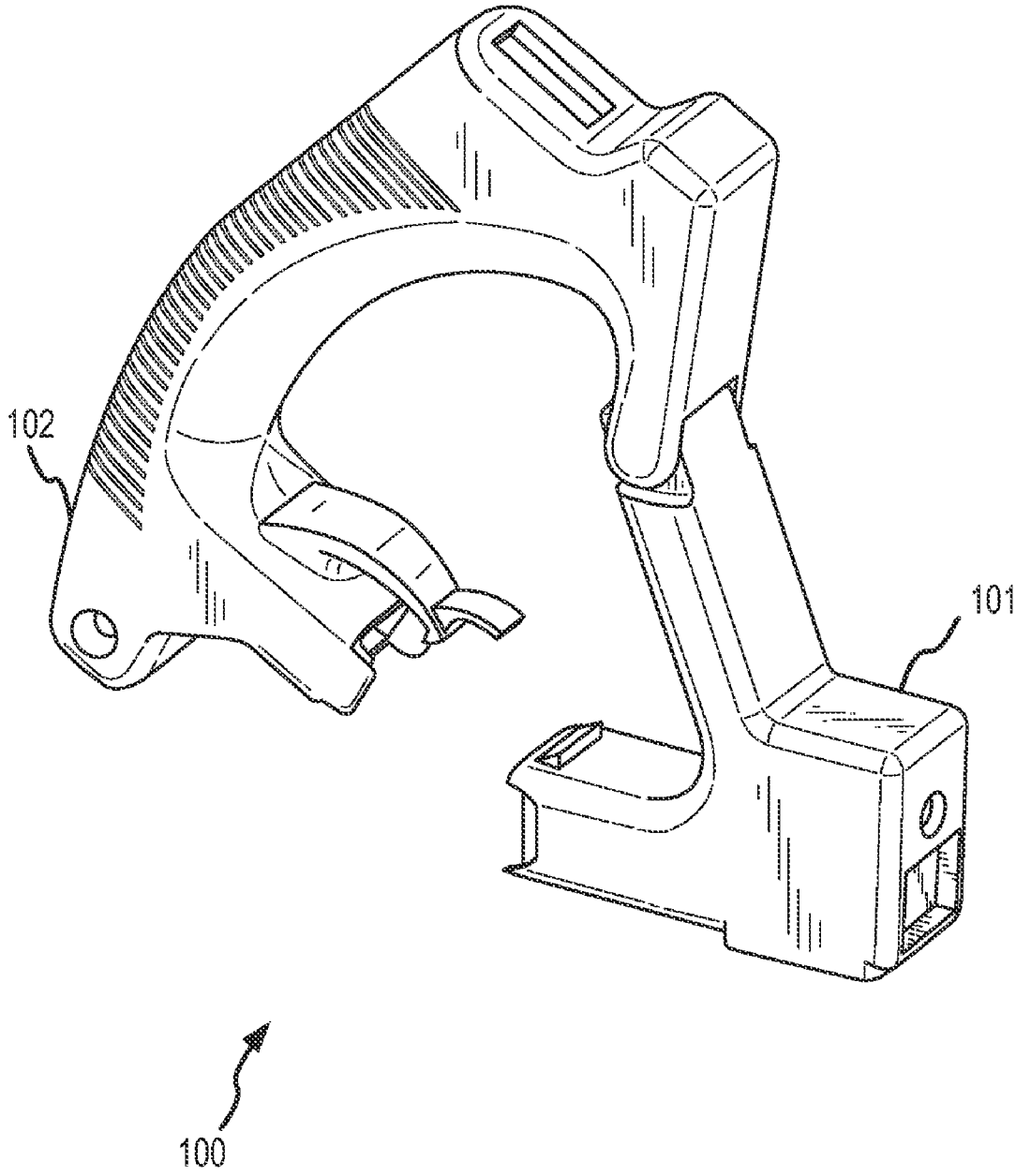
FIG. 3 shows the handle grip in a partially pivoted position with respect to the base.

FIG. 3 shows the handle grip 102 in a partially pivoted position with respect to the base 101. This position may be desirable in some situations, such as when using the associated appliance or vacuum cleaner in an intermediate or high position. This position can be achieved where the appliance handle 100 is configured to offer a substantially continuous range of pivotal motion or where the appliance handle 100 is configured to include one or more detent positions between the fully open and fully closed pivotal positions.

FIG. 4 shows the handle grip 102 in a fully opened or fully pivoted position with respect to the base 101. This fully open position may be desirable in some situations, such as when using the associated appliance or vacuum cleaner in a low position.

Figure 5:
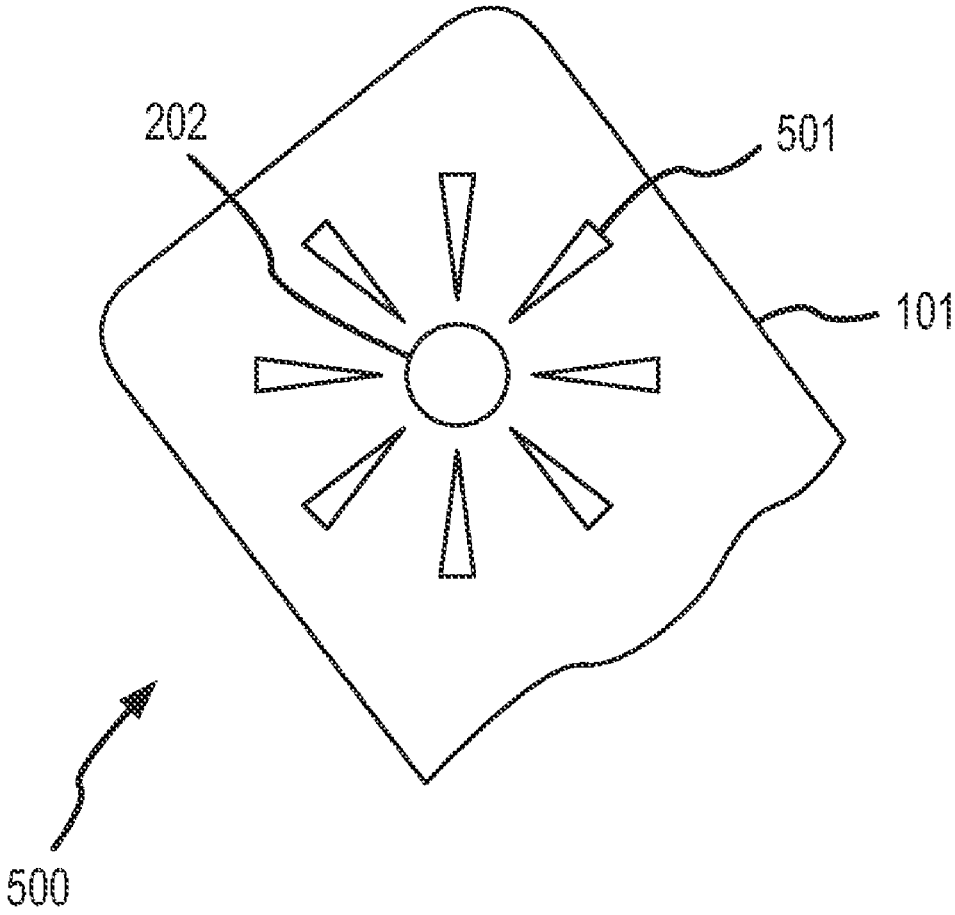
FIG. 5 shows a portion of the base that includes a detent device according to an embodiment of the invention.

FIG. 5 shows a portion of the base 101 that includes a detent device 500 according to an embodiment of the invention. In the embodiment shown, the detent device 500 includes one or more projections 501 that extend from a face of the base 101 around the base pivot aperture 202. The projections 501 provide detents that restrain the pivotal motion of the handle grip 102 in relation to the base 101. The projections can comprise any manner of bumps, points, ridges, knurling or roughening, etc. The number and placement of the ridges 501 can be chosen to provide the desired number and placement of detent positions. One or both sides of this portion of the base 101 can include these projections 501.

In addition, the handle grip 102 can include corresponding ridges or grooves. The interaction of corresponding ridges on the base 101 and the handle grip 102 provides an increased detent action. It should be understood that alternatively the detent device 500 could comprise grooves or depressions on the base 101 and corresponding ridges or projections on the handle grip 102.

The ergonomic appliance handle of the invention can be implemented according to any of the embodiments in order to obtain several advantages, if desired. The invention can provide an ergonomically improved appliance handle. The invention can provide a pivotal appliance handle that can be pivoted by the user. The handle grip can be ergonomically positioned by the user according to the user's requirements and preferences. The invention can accommodate various users, various appliances, and various uses, applications, and orientations.

The pivot device of the invention is spaced-apart from the pivot restraint device, thereby reducing the stress on the pivot device. The invention provides a pivoting handle that does not concentrate all force on a single spot.

The invention can provide a pivoting handle that provides a first, latched position and a second, maximum pivotal position away from the pivot restraint device. The invention can provide a pivoting handle that can continuously pivot between a closed position and a maximal pivotal (open) position. The invention can provide a pivoting handle that can be clamped at any position between a closed position and a maximal pivotal position.

What is claimed is:

1. An ergonomic appliance handle, comprising:

a handle base affixed substantially on an upper end of a handle portion of an appliance;

a handle grip;

a pivot means for pivotally attaching the handle grip to the handle base, with the pivot means being positioned at a first location on the handle base and with the pivot means allowing the handle grip to pivot on the handle base between at least two pivoting positions; and a pivot restraint means for removably latching the handle grip in a closed position of the at least two pivoting positions, with the pivot restraint means being positioned at a second location on the handle base that is spaced-apart from the first location.

2. The ergonomic appliance handle of claim 1, wherein the handle grip pivots between the closed position with the pivot restraint means operatively restraining the handle grip to the handle base and a second position wherein the handle grip is at a maximum pivotal position away from the pivot restraint means.

3. The ergonomic appliance handle of claim 1, wherein the handle grip pivots between the closed position with the pivot restraint means operatively restraining the handle grip to the handle base and a second position wherein the handle grip is at a maximum pivotal position away from the pivot restraint means, and wherein the handle grip can pivot substantially continuously between the closed position and the second position.

4. The ergonomic appliance handle of claim 1, with the appliance comprising a vacuum cleaner.

5. The ergonomic appliance handle of claim 1, with the pivot means comprising:

a pivot aperture formed in at least one of the handle base and the handle grip; and an axle passing through the pivot aperture and of a size to rotate in the pivot aperture.

6. The ergonomic appliance handle of claim 1, further comprising a detent means for stopping a pivotal motion of the handle grip at one or more predetermined detent locations.

7. The ergonomic appliance handle of claim 1, further comprising:

a power switch located in the handle grip portion; and wiring extending from the power switch and through the pivot means to the handle base.

8. The ergonomic appliance handle of claim 1, wherein the handle grip pivots between the closed position with the pivot restraint means operatively restraining the handle grip to the handle base and a second position wherein the handle grip is at a maximum pivotal position, and wherein the handle grip can pivot substantially continuously between the closed position and the second position and with the pivot means further comprising a stop means for clamping the handle grip to the handle base at any pivoting position.

9. An ergonomic appliance handle, comprising:

a handle base affixed substantially on an upper end of a handle portion of an appliance;

a handle grip;

a pivot means for pivotally attaching the handle grip to the handle base, with the pivot means being positioned at a first location on the handle base and with the pivot means allowing the handle grip to pivot on the handle base between at least two pivoting positions;

a pivot restraint means for removably latching the handle grip in a closed position of the at least two pivoting positions, with the pivot restraint means being positioned at a second location on the handle base that is spaced-apart from the first location; and a detent means for restraining a pivotal motion of the handle grip at one or more predetermined detent locations.

10. The ergonomic appliance handle of claim 9, wherein the handle grip pivots between the closed position with the pivot restraint means operatively restraining the handle grip to the handle base and a second position wherein the handle grip is at a maximum pivotal position away from the pivot restraint means.

11. The ergonomic appliance handle of claim 9, wherein the handle grip pivots between the closed position with the pivot restraint means operatively restraining the handle grip to the handle base and a second position wherein the handle grip is at a maximum pivotal position away from the pivot restraint means, and wherein the handle grip can pivot substantially continuously between the closed position and the second position.

12. The ergonomic appliance handle of claim 9, with the appliance comprising a vacuum cleaner.

13. The ergonomic appliance handle of claim 9, with the pivot means comprising:

a pivot aperture formed in at least one of the handle base and the handle grip; and an axle passing through the pivot aperture and of a size to rotate in the pivot aperture.

14. The ergonomic appliance handle of claim 9, further comprising:

a power switch located in the handle grip portion; and wiring extending from the power switch and through the pivot means to the handle base.

15. The ergonomic appliance handle of claim 9, wherein the handle grip pivots between the closed position with the pivot restraint means operatively restraining the handle grip to the handle base and a second position wherein the handle grip is at a maximum pivotal position, and wherein the handle grip can pivot substantially continuously between the closed position and the second position and with the pivot means further comprising a stop means for clamping the handle grip to the handle base at any pivoting position.

16. An ergonomic appliance handle, comprising:

a handle base affixed substantially on an upper end of a handle portion of an appliance;

a handle grip;

a pivot means for pivotally attaching the handle grip to the handle base, with the pivot means being positioned at a first location on the handle base and with the pivot means allowing the handle grip to pivot on the handle base between at least two pivoting positions;

a pivot restraint means for removably latching the handle grip in a closed position of the at least two pivoting positions, with the pivot restraint means being positioned at a second location on the handle base that is spaced-apart from the first location;

a power switch located in the handle grip portion; and wiring extending from the power switch and through the pivot means to the handle base.

17. The ergonomic appliance handle of claim 16, wherein the handle grip pivots between the closed position with the pivot restraint means operatively restraining the handle grip to the handle base and a second position wherein the handle grip is at a maximum pivotal position away from the pivot restraint means.

18. The ergonomic appliance handle of claim 16, wherein the handle grip pivots between the closed position with the pivot restraint means operatively restraining the handle grip to the handle base and a second position wherein the handle grip is at a maximum pivotal position away from the pivot restraint means, and wherein the handle grip can pivot substantially continuously between the closed position and the second position.

19. The ergonomic appliance handle of claim 16, with the appliance comprising a vacuum cleaner.

20. The ergonomic appliance handle of claim 16, with the pivot means comprising:

a pivot aperture formed in at least one of the handle base and the handle grip; and an axle passing through the pivot aperture and of a size to rotate in the pivot aperture.

21. The ergonomic appliance handle of claim 16, further comprising a detent means for stopping a pivotal motion of the handle grip at one or more predetermined detent locations.

22. The ergonomic appliance handle of claim 16, wherein the handle grip pivots between the closed position with the pivot restraint means operatively restraining the handle grip to the handle base and a second position wherein the handle grip is at a maximum pivotal position, and wherein the handle grip can pivot substantially continuously between the closed position and the second position and with the pivot means further comprising a stop means for clamping the handle grip to the handle base at any pivoting position.

23. An ergonomic appliance handle, comprising:

a handle base affixed substantially on an upper end of a handle portion of an appliance;

a handle grip;

a pivot means for pivotally attaching the handle grip to the handle base, with the pivot means being positioned at a first location on the handle base and with the pivot means allowing the handle grip to pivot on the handle base between at least two pivoting positions;

a pivot restraint means for removably latching the handle grip in a closed position of the at least two pivoting positions, with the pivot restraint means being positioned at a second location on the handle base that is spaced-apart from the first location, wherein the handle grip pivots between the closed position with the pivot restraint means operatively restraining the handle grip to the handle base and at least a second position wherein the handle grip is at a maximum pivotal position away from the pivot restraint means, and wherein the handle grip can pivot substantially continuously between the closed position and the second position; and a stop means for clamping the handle grip to the handle base at any pivoting position, with the stop means being positioned at the first location and operatively clamping the handle grip to the handle base at any pivoting position.

24. The ergonomic appliance handle of claim 23, with the appliance comprising a vacuum cleaner.

25. The ergonomic appliance handle of claim 23, with the pivot means comprising:

a pivot aperture formed in at least one of the handle base and the handle grip; and an axle passing through the pivot aperture and of a size to rotate in the pivot aperture.

26. The ergonomic appliance handle of claim 23, further comprising a detent means for stopping a pivotal motion of the handle grip at one or more predetermined detent locations.

27. The ergonomic appliance handle of claim 23, further comprising:

a power switch located in the handle grip portion; and wiring extending from the power switch and through the pivot means to the handle base.

* * * * *